US011326560B1

(12) United States Patent
Dudar

(10) Patent No.: US 11,326,560 B1
(45) Date of Patent: May 10, 2022

(54) METHOD AND SYSTEM FOR PERFORMING EVAPORATIVE EMISSIONS DIAGNOSTICS

(71) Applicant: Ford Global Technologies, LLC, Dearborn, MI (US)

(72) Inventor: Aed Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/304,080

(22) Filed: Jun. 14, 2021

(51) Int. Cl.
*F02M 25/08* (2006.01)
*F01P 7/16* (2006.01)

(52) U.S. Cl.
CPC ..... *F02M 25/0818* (2013.01); *F01P 7/16* (2013.01); *F02M 25/0836* (2013.01); *F01P 2025/13* (2013.01); *F01P 2025/60* (2013.01); *F01P 2031/30* (2013.01); *F01P 2037/00* (2013.01)

(58) Field of Classification Search
CPC ..... F02M 25/0809; F02M 25/0818; F02M 2025/0881; F02D 41/0032; F02D 41/004; F02D 2041/225
See application file for complete search history.

(56) References Cited

U.S. PATENT DOCUMENTS 6,089,081 A * 7/2000 Cook ..... F02M 25/0809 73/114.39
6,314,797 B1 * 11/2001 Dawson ..... F02M 25/0809 73/49.2
6,363,921 B1 * 4/2002 Cook ..... F02M 25/0809 123/519
6,536,261 B1 * 3/2003 Weldon ..... F02M 25/0809 123/520
9,696,234 B2 7/2017 Tseng et al.
9,824,512 B2 11/2017 Tseng et al.
10,018,158 B2 7/2018 Dudar
10,378,486 B2 8/2019 Dudar
10,884,350 B2 1/2021 Takebayashi et al.
2004/0250795 A1 * 12/2004 Stroia ..... F02M 37/0047 123/447
2006/0048752 A1 * 3/2006 Stroia ..... F02M 25/0827 123/458
2009/0277251 A1 11/2009 Takakura
2017/0016795 A1 1/2017 Dudar et al.
2017/0350351 A1 * 12/2017 Lucka ..... F04B 37/00
2017/0363046 A1 * 12/2017 Dudar ..... F02M 25/0827
2018/0066595 A1 * 3/2018 Dudar ..... F02D 41/0037
2019/0040822 A1 2/2019 Dudar
2019/0137940 A1 * 5/2019 Jentz ..... B60W 50/045
2019/0226415 A1 * 7/2019 Woodring ..... F02D 41/1498

OTHER PUBLICATIONS

Davies, A., "A Little Fan That Fixes the Turbocharger's Biggest Problem: BorgWarner's e-booster kills the much-hated turbo lag," WIRED Website, Available Online at https://www.wired.com/2017/04/little-fan-fixes-turbochargers-biggest-problem/#:~:text=BorgWarner's%20e%2Dbooster%20kills%20the%20much%2Dhated%20turbo%20lag.&text=While%20any%20self%2Drespecting%20futurist,throwing%20in%20the%20oily%20towel., Apr. 28, 2017, 5 pages.

* cited by examiner

*Primary Examiner* — Long T Tran
(74) *Attorney, Agent, or Firm* — Geoffrey Brumbaugh; McCoy Russell LLP

(57) ABSTRACT

Methods and systems for performing diagnostics on an evaporative emission are described. The methods and systems may include evaluating pressure or vacuum development within an evaporative emissions system over time to determine the presence or absence of a breach in the evaporative emissions system. If a breach is identified, mitigating actions may be performed.

20 Claims, 6 Drawing Sheets

METHOD AND SYSTEM FOR PERFORMING EVAPORATIVE EMISSIONS DIAGNOSTICS

FIELD

The present description relates generally to methods and systems for performing evaporative emissions testing.

BACKGROUND/SUMMARY

A vehicle may include an evaporative emissions system for reducing emissions of hydrocarbons into ambient air. The evaporative emissions system may store fuel vapors in a canister that includes carbon when a fuel tank is exposed to heat. The canister may release fuel vapors into an internal combustion engine so that the fuel vapors may be combusted. The evaporative emissions system may also include hoses to couple the fuel tank to the canister and to couple the canister to the internal combustion engine. Emissions regulators may require a diagnostic test to ensure that the integrity of the evaporative emissions system is intact and without a breach that may permit the release of fuel vapors into the atmosphere. One way to ascertain whether or not one or more breaches are present in the evaporative emissions system is to pressurize the evaporative emissions system. Another way to ascertain whether or not one or more breaches are present in the evaporative emissions system is to draw a vacuum on the evaporative emissions system. Such diagnostics may be performed when a vehicle is deactivated so that the evaporative emissions system does not have to store or release fuel vapors while the diagnostic is being performed. Additionally, natural heating and cooling of fuel in the fuel system may permit pressure and vacuum to form without use of a pump. However, the natural heating and cooling (e.g., heating and cooling via ambient air temperature and solar heating) of the vehicle's fuel system may also prevent a threshold amount of pressure or vacuum from building in the evaporative emissions system so that it may be judged that a breach is present in the evaporative emissions system when no such breach is present.

The inventor herein has recognized the above-mentioned issue and has developed a method for operating an evaporative emissions system, comprising: increasing cooling of an engine via a controller in response to an indication that a natural cooling of an evaporative emissions system is expected to increase from a time the engine is stopped.

By increasing cooling of an engine in response to an indication that a natural cooling of an evaporative emissions system is expected to increase from a time that the engine is stopped, it may be possible to provide the technical result of reducing false positive indications for evaporative emissions system breaches. In particular, the engine may be cooled before an engine is stopped during conditions where natural cooling of the evaporative emissions system is expected to increase so that a threshold vacuum level may be achieved sooner. Consequently, less heat may be transferred from an engine to an evaporative emissions system so that natural cooling of the evaporative emissions system may cause generation of a threshold amount of vacuum in the evaporative emissions system sooner.

The present description may provide several advantages. In particular, the approach may reduce false positive evaporative emissions system degradation indications. Additionally, the approach may be implemented to improve diagnostics when pressure is expected to increase within the evaporative emissions system or when vacuum is expected to increase within the evaporative emissions system. Further, the approach may reduce an amount of time it takes to perform an evaporative emissions system diagnostic.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 2:
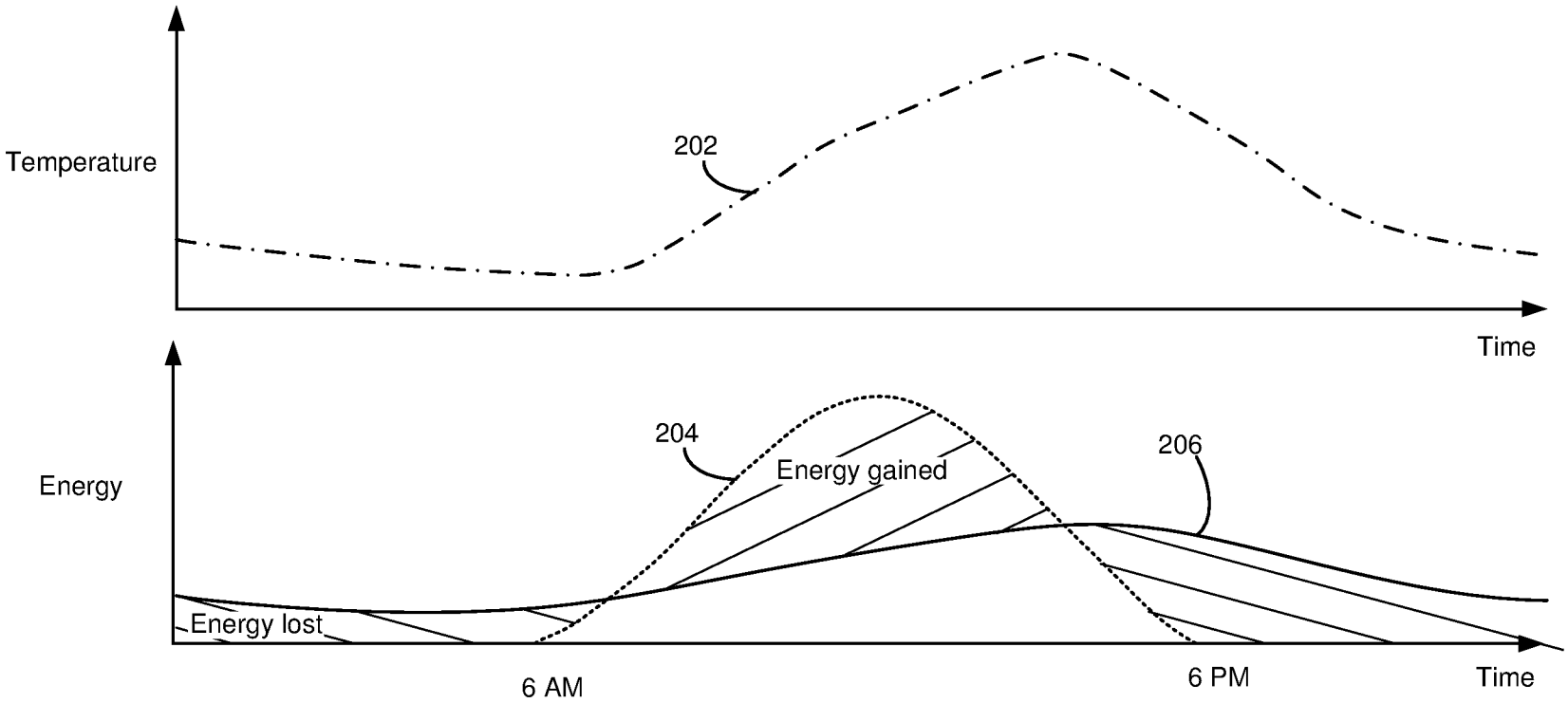
FIG. 2 shows plots of an example 24 hour diurnal temperature cycle.
Figure 3:
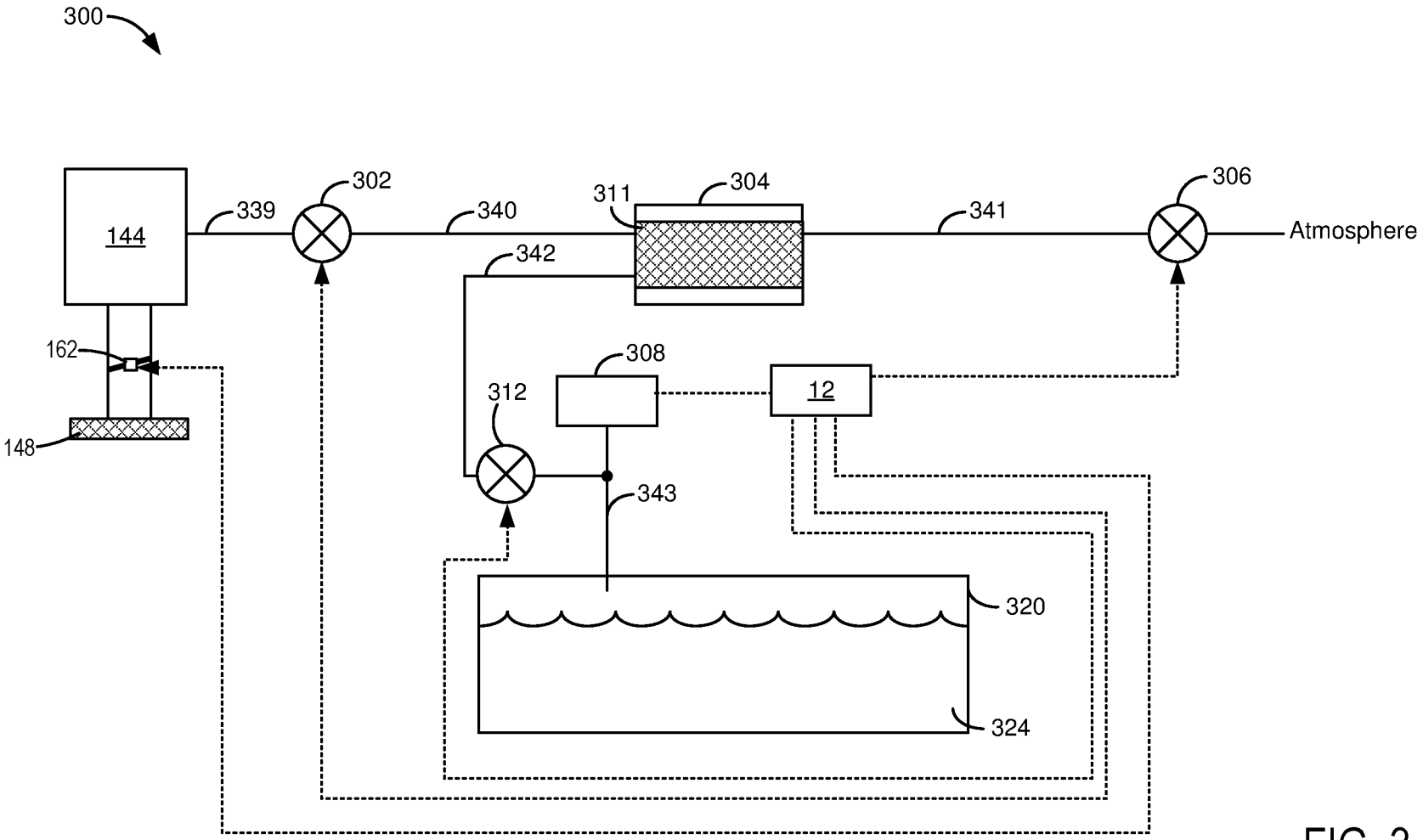
FIG. 3 shows a block diagram of an example evaporative emissions system for the vehicle.

The following description relates to systems and methods for improving engine off natural vacuum evaporative emissions diagnostic testing. The system and methods described herein strategically utilize weather data to determine if a pressurization diagnostic or a vacuum diagnostic for an evaporative emissions system is to be initiated upon stopping of an engine. The engine may be of the type shown in FIG. 1. The engine and evaporative emissions system may be subject to a twenty four hour diurnal temperature cycle as shown in FIG. 2. The evaporative emissions system may be configured as shown in FIG. 3. FIGS. 4-7 show prior art examples of how an evaporative emissions system may be operated. A method for operating an engine and an evaporative emissions system is shown in FIG. 8.

Figure 1:
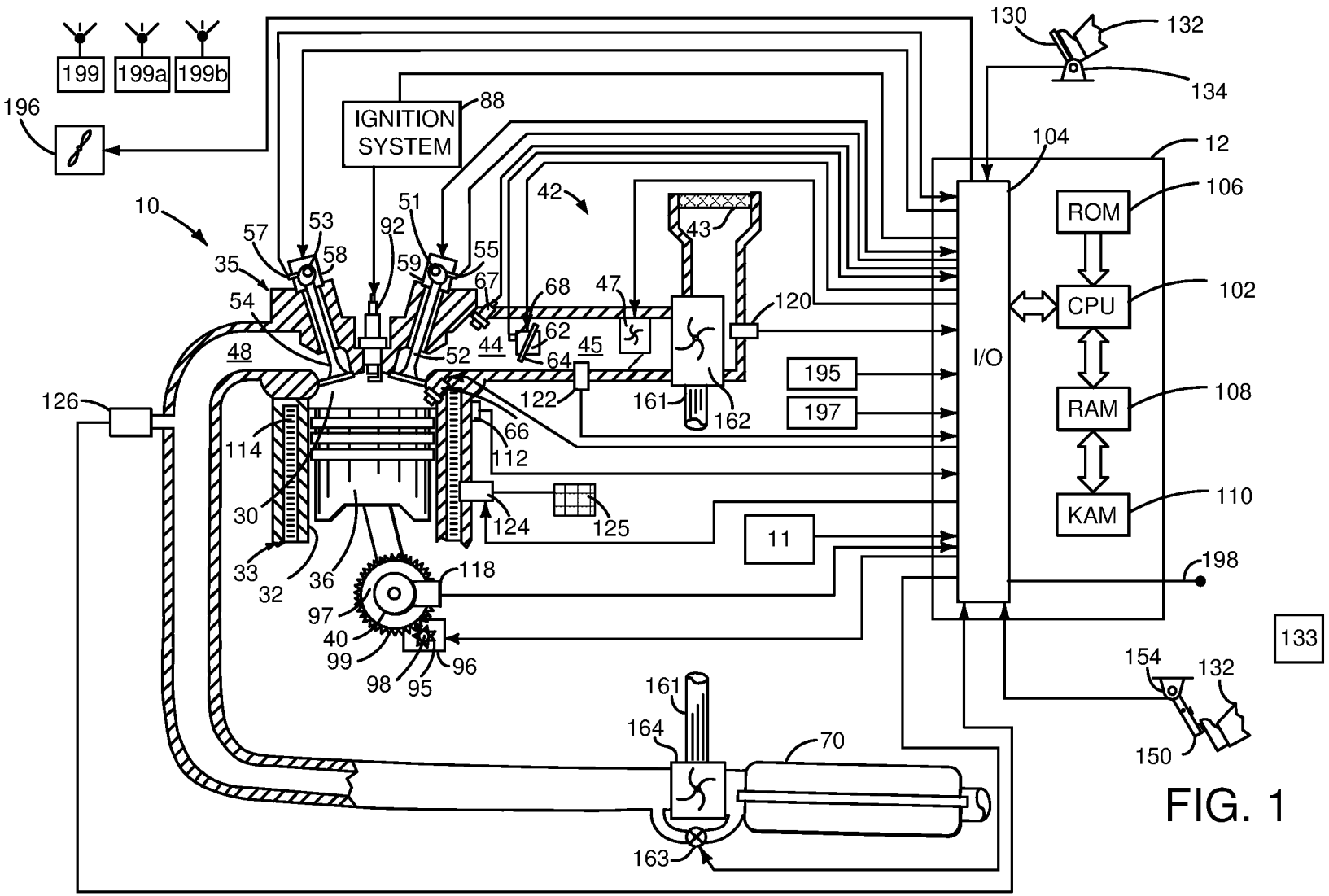
FIG. 1 shows an example internal combustion engine of a vehicle.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1 and 2. The controller employs the actuators shown in FIGS. 1 and 2 to adjust engine and driveline or powertrain operation based on the received signals and instructions stored in memory of controller 12.

Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99. Optional starter 96 may be directly mounted to the front of the engine or the rear of the engine. In some examples, starter 96 may selectively supply power to crankshaft 40 via a belt or chain. In addition, starter 96 is in a base state when not engaged to the engine crankshaft 40 and flywheel ring gear 99.

Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation device 59. Exhaust valve 54 may be selectively activated and deactivated by valve activation device 58. Valve activation devices 58 and 59 may be electromechanical devices.

Direct fuel injector 66 is shown positioned to inject fuel directly into cylinder 30, which is known to those skilled in the art as direct injection. Port fuel injector 67 is shown positioned to inject fuel into the intake port of cylinder 30, which is known to those skilled in the art as port injection. Fuel injectors 66 and 67 deliver liquid fuel in proportion to pulse widths provided by controller 12. Fuel is delivered to fuel injectors 66 and 67 by a fuel system (not shown) including a fuel tank, fuel pump, and fuel rail (not shown). Fuel pump 195 may supply fuel to direct fuel injector 66 and port fuel injector 67. Fuel pump 195 may be activated and deactivated via controller 12.

In addition, intake manifold 44 is shown communicating with turbocharger compressor 162, electric booster 47, and engine air intake 42. In other examples, compressor 162 may be a supercharger compressor. Shaft 161 mechanically couples turbocharger turbine 164 to turbocharger compressor 162. Electric booster 47 may be activated and deactivated via controller. Electric booster 47 (e.g., a compressor that is driven via an electric machine) may compress air entering from air intake 42 when activated. Electric booster 47 may be activated when engine 10 is running or stopped (e.g., its crankshaft is not rotating and there is no combustion in the engine). Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of three-way catalyst 70. Alternatively, a two-state exhaust gas oxygen sensor may be substituted for UEGO sensor 126.

Catalyst 70 may include multiple bricks and a three-way catalyst coating, in one example. In another example, multiple emission control devices, each with multiple bricks, can be used.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a driver demand pedal 130 (e.g., a human/machine interface) for sensing force applied by human driver 132; a position sensor 154 coupled to brake pedal 150 (e.g., a human/machine interface) for sensing force applied by human driver 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined. Controller 12 may also receive commands from and provide engine data to autonomous driver 133. Autonomous driver 133 may provide commands to the vehicle to drive the vehicle to a destination.

Controller 12 may also adjust a temperature of engine 10 via thermostat 124 and fan 196. Thermostat 124 controls coolant flow between engine 10 and radiator 125, and fan 196 may control air flow over radiator 125. During high engine loads, thermostat 124 may be opened farther and fan speed may be increased to provide additional cooling to engine 10. During low engine loads and low ambient temperatures, thermostat 124 may be closed further and fan speed may be reduced to reduce coolant flow and heat transfer between engine 10 and radiator 125.

Controller 12 may also receive input from human/machine interface 11. A request to start or stop the engine or vehicle may be generated via a human and input to the human/machine interface 11. The human/machine interface 11 may be a touch screen display, pushbutton, key switch or other known device. Controller 12 may also receive data such as weather forecasts and present time of day data via antenna 198. Antenna 198 may receive data that is broadcast from remote server 199. Data may be broadcast from remote server 199 via a satellite **199*a* or cellular network 199*b*. Controller 12 may also receive data from navigation system 197**. Navigation data may include vehicle destination and time to destination.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational power of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, plots of an exemplary twenty four hour diurnal temperature cycle are shown. The diurnal temperature cycle shows how ambient air temperature may increase and decrease through a day. The amount of temperature increase and decrease may be depending on time or year, geographic location, and conditions of a particular day.

The first plot from the top of FIG. 2 is a plot of ambient temperature versus time of day. The vertical axis represents ambient temperature and ambient temperature increases in the direction of the vertical axis arrow. The horizontal axis represents time and time increases from the left side of the figure to the right side of the figure. Trace 202 represents ambient air temperature during a twenty four hour period.

The second plot from the top of FIG. 2 is a plot of energy versus time. The vertical axis represents energy and energy increases in the direction of the vertical axis arrow. The horizontal axis represents time and time increases from the left side of the figure to the right side of the figure. Trace 204 represents solar radiation that is absorbed to a vehicle. Trace 206 represents net long wave radiation loss from a vehicle.

In this example, the ambient air temperature begins to increase near 6 A.M. and it begins to decrease before 6 P.M. The energy added to the vehicle increases during the cross hatched area labeled "Energy gained." The energy lost from the vehicle is indicated by the second cross hatched area that is labeled "Energy lost." It may be observed that energy is added to the vehicle after 6 A.M. and then energy is removed from the vehicle after the ambient temperature passes a peak. During the time period that energy is added to the vehicle, the energy may heat the contents of the evaporative emissions system such that it increases pressure within the evaporative emissions system provided that the canister purge valve is closed. Conversely, energy is removed from the vehicle outside of the time that energy is added to the vehicle. The energy loss from the vehicle may cause a vacuum to be generated in the vehicle's evaporative emissions system as fuel vapor condenses.

The times and relatively levels of heat added and heat removed from a vehicle shown in FIG. 2 are for illustration purposes only. During the course of a year for a particular geographic location, the heat added and heat removed levels may vary. In addition, the hours that heat is added or removed may also vary throughout a year.

Referring now to FIG. 3, a block diagram of an example evaporative emissions system 300 is shown. Evaporative emissions system 300 includes a canister purge valve 302, a carbon filled canister 304, a canister vent valve 306, a fuel tank pressure sensor 308, a fuel tank vent valve 312, and a fuel tank 320. Carbon filled canister 304 may include activated carbon 311 to store fuel vapors.

Canister purge valve 302 may selectively provide fluidic communication between carbon canister 304 and intake manifold 144. Canister vent valve 306 is normally open so that air that is stripped of fuel vapor may exit to ambient air. During engine off natural vacuum diagnostics, the canister purge valve 302 may be closed and the canister vent valve 306 may be closed so that pressure or vacuum may develop in evaporative emissions system 300.

Conduit 339 provides fluid communication between intake manifold 144 and canister purge valve 302. Conduit 340 provides fluid communication between canister purge valve 302 and carbon canister 304. Conduit 341 provides fluid communication between carbon canister 304 and canister vent valve 306. Conduit 342 provides fluid communication between carbon canister 304 and fuel tank vent valve 312. Conduit 343 provides fluid communication between fuel tank vent valve 312 and fuel tank 320. Fuel tank 320 may store fuel 324.

Thus, the system of FIGS. 1 and 3 provides for a vehicle system, comprising: an engine; an evaporative emissions system coupled to the engine; a controller including executable instructions stored in non-transitory memory that cause the controller to perform an evaporative emissions system diagnostic while the engine is off, the evaporative emissions system diagnostic including pressurizing the evaporative emissions system in response to an indication that the engine is stopped during a time range where energy input from a vehicle environment into the evaporative emissions system is expected to increase within a threshold amount of time since the engine is most recently turned off. The vehicle system includes where the pressurizing increases a pressure in the evaporative emissions system, and where the pressurizing is facilitated via ambient air temperature increasing. The vehicle system further comprises additional executable instructions to close a canister vent valve to pressurize the evaporative emissions system. The vehicle system includes where the evaporative emissions diagnostic includes generating a vacuum in the evaporative emissions system in response to an indication that the engine is stopped during a time range where energy input from a vehicle environment into the evaporative emissions system is expected to decrease within a threshold amount of time since the engine is most recently turned off. The vehicle system further comprises additional executable instructions to indicate degradation of the evaporative emissions system. The vehicle system further comprises additional executable instructions to adjust vehicle operation in response to degradation of the evaporative emissions system. The vehicle system includes where the time range begins when the engine is stopped Referring now to FIG. 4, an example sequence for performing an engine off diagnostic to determine if there is a breach in an evaporative emissions system is shown. In this example, the engine off diagnostic is performed when an amount of energy added to the vehicle via ambient air temperature and solar load is increasing. In this sequence, the evaporative emissions system is monitored for increasing pressure. This sequence may be performed according to the method of FIG. 8. Vertical markers at times t0-t2 represent times of interest during the sequence. The two plots occur at a same time.

Figure 4:
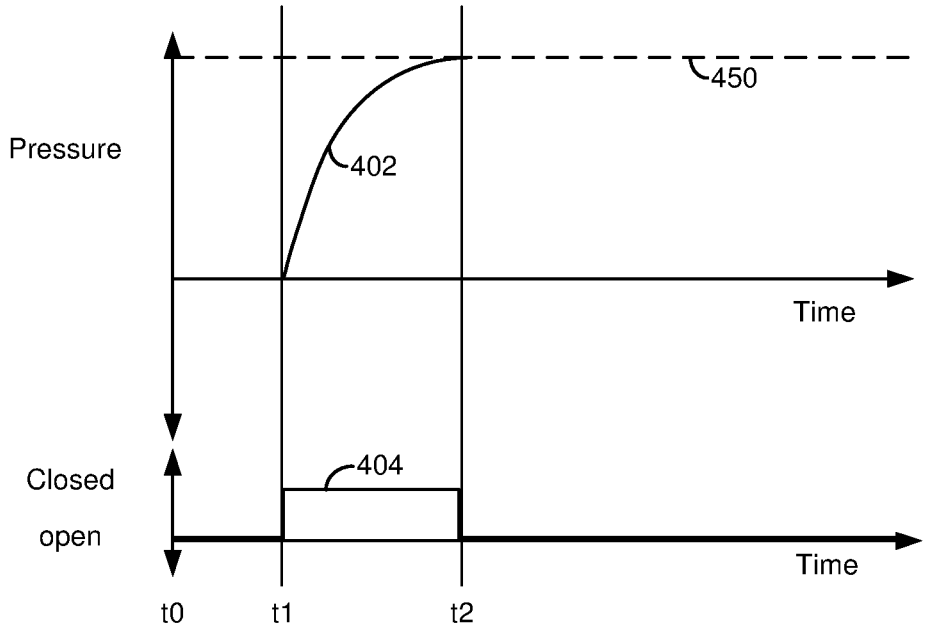
FIGS. 4-7 shows an example evaporative emission system operating sequences.

The first plot from the top of FIG. 4 is a plot of pressure in the evaporative emissions system versus time. The vertical axis represents pressure in the evaporative emissions system and the pressure increases in the direction of the vertical axis arrow. The pressure at the level of the horizontal axis is zero. The horizontal axis represents time and time increases from the left side of the plot to the right side of the plot. Trace 402 represents pressure in the evaporative emissions system.

The second plot from the top of FIG. 4 is a plot of canister vent valve (CVV) state versus time. The vertical axis represents the CVV state and the CVV is closed when trace 404 is at a higher level near the vertical axis arrow. The CVV is fully open when trace 404 is at a lower level near the horizontal axis. Trace 404 represents the state of the CVV.

At time t0, the CVV is open and the pressure in the evaporative emissions system is low. The CVV is closed at time t1, which allows pressure to increase in the evaporative emissions system. The pressure in the evaporative emissions increases between time t1 and time t2. At time t2, pressure in the evaporative emissions system reaches the level of upper threshold 450. The evaporative emissions system passes the engine off diagnostic when pressure in the evaporative emissions system reaches threshold 450, which indicates no breach in the evaporative emission system Referring now to FIG. 5, an example sequence for performing an engine off diagnostic to determine if there is a breach in an evaporative emissions system is shown. In this example, the engine off diagnostic is performed when an amount of energy removed from the vehicle via ambient air temperature is decreasing. In this sequence, the evaporative emissions system is monitored for decreasing pressure (vacuum). This sequence may be performed according to the method of FIG. 8. Vertical markers at times t10-t12 represent times of interest during the sequence. The two plots occur at a same time.

Figure 5:
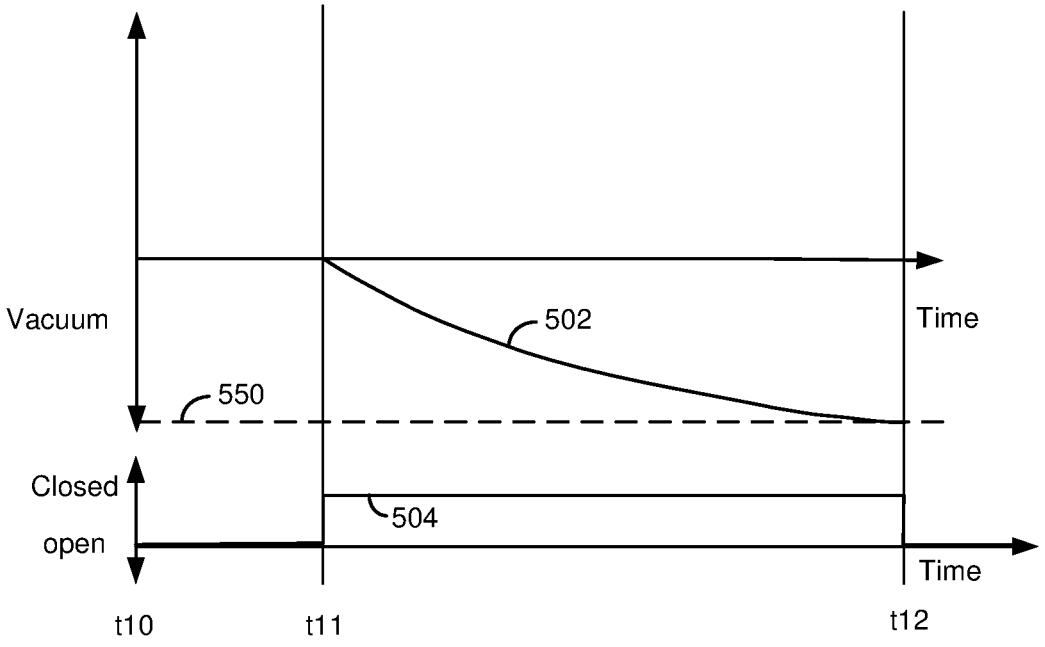

The first plot from the top of FIG. 5 is a plot of pressure in the evaporative emissions system versus time. The vertical axis represents pressure in the evaporative emissions system and the pressure increases in the direction of the vertical axis arrow. The pressure below the level of the horizontal axis is less than zero (e.g., a vacuum). The horizontal axis represents time and time increases from the left side of the plot to the right side of the plot. Trace 502 represents vacuum in the evaporative emissions system.

The second plot from the top of FIG. 5 is a plot of canister vent valve (CVV) state versus time. The vertical axis represents the CVV state and the CVV is closed when trace 504 is at a higher level near the vertical axis arrow. The CVV is fully open when trace 504 is at a lower level near the horizontal axis. Trace 504 represents the state of the CVV.

At time t10, the CVV is open and the vacuum in the evaporative emissions system is zero. The CVV is closed at time t11, which allows vacuum magnitude to increase in the evaporative emissions system. The vacuum magnitude in the evaporative emissions increases between time t11 and time t12. At time t12, vacuum in the evaporative emissions system reaches the level of threshold 550. The evaporative emissions system passes the engine off diagnostic when vacuum in the evaporative emissions system reaches threshold 550, which indicates no breach in the evaporative emission system.

Figure 6:
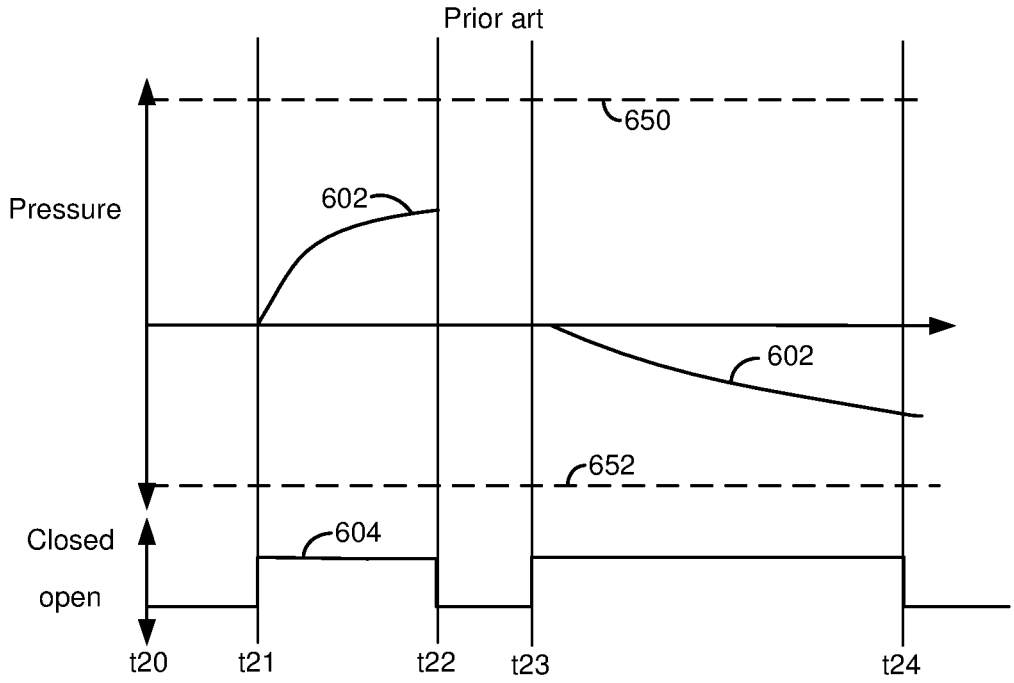

Referring now to FIG. 6, an example prior art sequence for performing an engine off diagnostic to determine if there is a breach in an evaporative emissions system is shown. In this example, the engine off diagnostic is performed when an amount of energy added to the vehicle via ambient air and solar load stops increasing shortly after the diagnostic begins, and an amount of energy removed from the vehicle begins increasing via a reduction in ambient air temperature and a reduction in solar load. In this sequence, the evaporative emissions system is initially monitored for increasing pressure and then it switches operation to monitor for decreasing pressure (vacuum). Vertical markers at times t20-t24 represent times of interest during the sequence. The two plots occur at a same time.

The first plot from the top of FIG. 6 is a plot of pressure in the evaporative emissions system versus time. The vertical axis represents pressure in the evaporative emissions system and the pressure increases in the direction of the vertical axis arrow. The pressure below the level of the horizontal axis is less than zero (e.g., a vacuum). The horizontal axis represents time and time increases from the left side of the plot to the right side of the plot. Trace 602 represents pressure or vacuum in the evaporative emissions system.

The second plot from the top of FIG. 6 is a plot of canister vent valve (CVV) state versus time. The vertical axis represents the CVV state and the CVV is closed when trace 604 is at a higher level near the vertical axis arrow. The CVV is fully open when trace 604 is at a lower level near the horizontal axis. Trace 604 represents the state of the CVV.

At time t20, the CVV is open and the pressure in the evaporative emissions system is zero. The CVV is closed at time t21, which allows pressure to increase in the evaporative emissions system. The pressure in the evaporative emissions increases between time t21 and time t22. However, the building of pressure stalls out and the pressure stops increasing. As a result, the CVV is opened at time t22 so that the system may be checked for its ability to hold a pressure. Thus, pressure in the build phase fails to reach threshold 650 so the evaporative emissions system does not pass the diagnostic at this time.

At time t23, the CVV is closed and vacuum starts to increase due to the temperature of the emissions system decreasing (not shown). Between time t23 and time t24, the magnitude of vacuum increases, but the vacuum fails to reach lower threshold 652 before the diagnostic times out and ends at time t24. Consequently, the vacuum does not reach lower threshold 652 and the evaporative emissions system may improperly indicate a breach condition because it failed to reach pressure threshold 650 or vacuum threshold 652.

Figure 7:
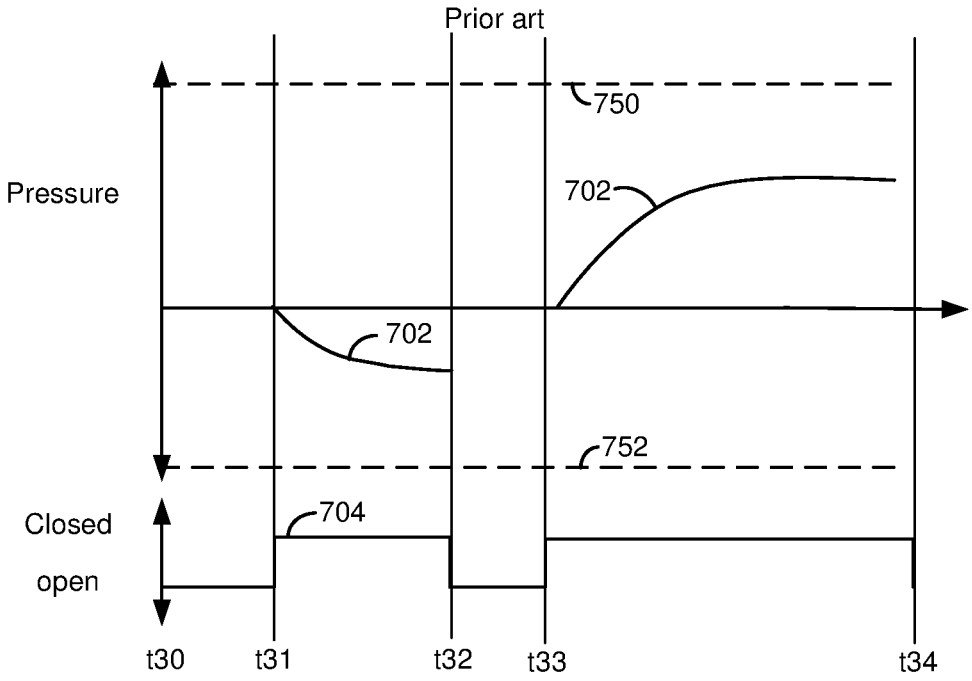
Figure 8:
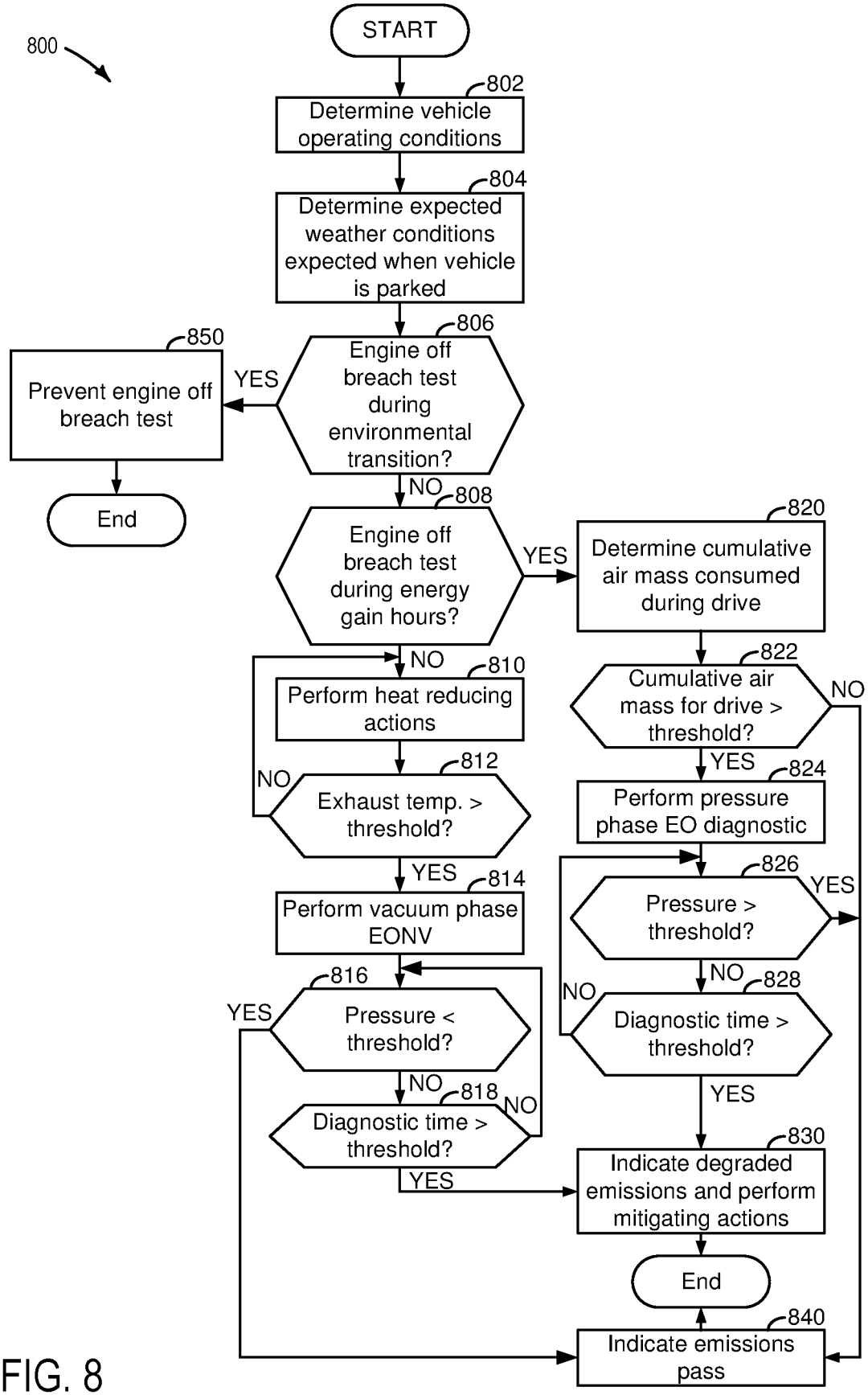
FIG. 8 shows an example method for operating an engine and an evaporative emissions system.

Referring now to FIG. 7, another example prior art sequence for performing an engine off diagnostic to determine if there is a breach in an evaporative emissions system is shown. In this example, the engine off diagnostic is performed when an amount of energy removed from the vehicle via ambient air stops increasing shortly after the diagnostic begins, and an amount of energy added to the vehicle begins increasing via an increase in ambient air temperature and an increase in solar load. In this sequence, the evaporative emissions system is initially monitored for decreasing pressure and then it switches operation to monitor for increasing pressure. Vertical markers at times t30-t34 represent times of interest during the sequence. The two plots occur at a same time.

The first plot from the top of FIG. 7 is a plot of pressure in the evaporative emissions system versus time. The vertical axis represents pressure in the evaporative emissions system and the pressure increases in the direction of the vertical axis arrow. The pressure below the level of the horizontal axis is less than zero (e.g., a vacuum). The horizontal axis represents time and time increases from the left side of the plot to the right side of the plot. Trace 702 represents pressure or vacuum in the evaporative emissions system.

The second plot from the top of FIG. 6 is a plot of canister vent valve (CVV) state versus time. The vertical axis represents the CVV state and the CVV is closed when trace 704 is at a higher level near the vertical axis arrow. The CVV is fully open when trace 704 is at a lower level near the horizontal axis. Trace 704 represents the state of the CVV.

At time t30, the CVV is open and the pressure in the evaporative emissions system is zero. The CVV is closed at time t31, which allows vacuum magnitude to increase in the evaporative emissions system. The vacuum magnitude in the evaporative emissions increases between time t31 and time t32. However, the building of vacuum stalls out and the vacuum stops increasing. As a result, the CVV is opened at time t32 so that the system may be checked for its ability to hold a pressure. Thus, vacuum in the build phase fails to reach threshold 752 so the evaporative emissions system does not pass the diagnostic at this time.

At time t33, the CVV is closed and pressure starts to increase due to the temperature of the emissions system increasing (not shown). Between time t33 and time t34, the pressure increases, but it fails to reach threshold 750 before the diagnostic times out and ends at time t34. Consequently, the pressure does not reach threshold 750 and the evaporative emissions system may indicate a breach condition because it failed to reach pressure threshold 750 or vacuum threshold 752.

Referring now to FIG. 8, an example method 800 for diagnosing a presence or absence of a breach in an evaporative emission system is shown. The method may monitor an evaporative emissions system for a threshold level of vacuum or a threshold level of positive pressure to determine the presence or absence of a breach. At least portions of method 800 may be included in and cooperate with a system as shown in FIGS. 1 and 3 as executable instructions stored in non-transitory memory. The method of FIG. 8 may cause the controller to actuate the actuators in the real world and receive data and signals from sensors described herein when the method is realized via executable instructions stored in controller memory.

At 802, method 800 determines vehicle operating conditions. Vehicle operating conditions may include but are not limited to ambient air temperature, engine speed, engine temperature, driver demand torque or power, spark timing, barometric pressure, intake inlet pressure, and engine air-fuel ratio. Method 800 may determine or infer these conditions from the various sensors mentioned herein. Method 800 proceeds to 804.

At 804, method 800 determines expected weather conditions at a location where the vehicle parks or is expected to park. The location that the vehicle is expected to park may be determined from user input into a navigation system. Weather conditions at the vehicle's destination (e.g., where the vehicle is expected to be parked) may be determined via an inquiry to a remote server that returns weather forecast data such as hourly temperature, cloud cover data, and future forecasts of ambient temperatures at the vehicle destination or where the vehicle is parked. From this data, the controller may determine day time hours where heat may be added to the vehicle and evaporative emissions system (e.g., when the ambient temperature is increasing and when cloud cover is low. Similarly, the controller may determine day time hours when heat may be removed from the vehicle and the evaporative emissions system (e.g., when the ambient temperature is decreasing). Method 800 proceeds to 806 after weather conditions at the expected vehicle parking location are determined or after weather conditions at the actual parking location of the vehicle are determined.

At 806, method 800 judge if an engine off evaporative emissions system breach diagnostic test is to be performed during an environmental transition. The environmental transition may occur at a time of the day when the environment changes from adding energy to the vehicle to removing energy from the vehicle or vice-versa. For example, the evaporative emissions system breach test may be judged to occur during an environmental transition if the emissions system diagnostic breach test will begin when the environment is adding energy to a vehicle (e.g., ambient air temperature is increasing or maintained and/or sun load is increasing or maintained) and ends, or is expected to end, when the environment is removing energy from the vehicle (e.g., ambient air temperature is decreasing and/or sun load is decreasing). Method 800 may determine if the environment is expected to add energy to the vehicle or remove energy from the vehicle according to weather data beginning at the time the vehicle is parked or is expected to be parked. Method 800 may also determine if the environment is expected to add or remove energy from the vehicle during the expected duration of the emissions system breach diagnostic based on the duration of the expected duration of the emissions system breach diagnostic and the weather data corresponding to the time that the emissions system breach diagnostic is to be performed.

If method 800 judges that an evaporative emissions system breach diagnostic test is to be performed during and environmental transition, the answer is yes and method 800 proceeds to 850. Otherwise, the answer is no and method 800 proceeds to 808. Additionally, if an evaporative emissions system breach diagnostic test is not scheduled to be performed, method 800 may proceed to 850.

At 850, method 800 prevents an evaporative emissions system breach diagnostic test from being performed. The evaporative emissions system breach diagnostic test may be prevented from occurring by maintaining the CVV in an open position. Method 800 proceeds to exit.

At 808, method 800 judge if an engine off evaporative emissions system breach diagnostic test is to be performed during a time period when the environment is adding energy to the vehicle (e.g. an energy gain period). For example, the evaporative emissions system breach test may be judged to occur during an energy adding time if the emissions system diagnostic breach test will begin and end within a time period when the environment is adding energy or maintaining a level of energy delivered to a vehicle (e.g., ambient air temperature is increasing or maintained and/or sun load is increasing or maintained). Method 800 may determine if the environment is expected to add energy to the vehicle according to weather data beginning at the time the vehicle is parked or is expected to be parked. Method 800 may also determine if the environment is expected to add energy to the vehicle during the expected duration of the emissions system breach diagnostic based on the duration of the expected duration of the emissions system breach diagnostic and the weather data corresponding to the time that the emissions system breach diagnostic is to be performed.

If method 800 judges that an evaporative emissions system breach diagnostic test is to be performed during and an energy adding period, the answer is yes and method 800 proceeds to 820. Otherwise, the answer is no and method 800 proceeds to 810. If the answer is no, method 800 judges that the engine off diagnostic test is to be performed during energy reducing hours where heat energy is transferred from the evaporative emissions system to ambient air.

At 810, method 800 performs vehicle heat reducing actions. Method 800 may take one or more actions to reduce heat that is transferred from a vehicle, including the vehicle's engine, to the evaporative emissions system. Heat may be transferred to the evaporative emissions system from ambient air, the vehicle's body, and from the vehicle's engine. The engine may transfer heat to the evaporative emissions system by heating fuel that is delivered to the engine's fuel rail and returned to the fuel tank without having been injected to the engine. The heat reducing actions may be performed before the vehicle is parked or while the vehicle is parked and before the evaporative emissions system diagnostic is initiated.

Heat reducing actions taken before the vehicle is parked may include but are not limited to opening a thermostat to cool the engine via engine coolant, activating an electric booster during vehicle deceleration while fuel flow is cut-off to the engine, increasing output of engine cooling fans, deactivate a fuel pump during deceleration fuel cut-off, and rotate the engine via an electric machine with the electric booster activated while fuel flow to the engine is stopped.

Opening the thermostat may quickly reduce engine temperature and heat transferred from the engine to the fuel that is returned to the fuel tank or the evaporative emissions system. Opening the thermostat increases coolant flow to the engine so that more heat may be extracted from the engine. The heat that is extracted from the engine may be transferred to ambient air via a radiator. The engine may be cooled in this way when the navigation system indicates that the vehicle is within a threshold distance of its expected parking location. Alternatively, the thermostat may be fully opened when the vehicle is parked and the engine is stopped.

The engine and exhaust system may also be cooled during deceleration fuel cut-off where the engine is rotated without injecting fuel to the engine while driver demand power is low. In particular, boost provided by an electric booster may be increased during deceleration fuel cut-off so that the engine and the engine's exhaust system may be cooled via flowing air through the engine and the exhaust system when the engine enters deceleration fuel cut-off within a predetermined distance of where the vehicle is predicted to be parked based on a destination input to the navigation system via a user (e.g., human or autonomous driver). The engine may also be cooled via activating the electric booster while the engine is rotated unfueled via an electric machine (e.g., a integrated starter/generator or a starter motor).

The engine may also be cooled via increasing output of engine cooling fans. The cooling fans may blow cool air over the engine and fuel system so as to cool evaporative emissions system components and fuel. Heat transfer to fuel in the fuel system and evaporative emissions system may also be reduced via deactivating a fuel pump so that fuel is not circulated from the engine back to the fuel system. Method 800 proceeds to 812 after heat reducing actions are taken.

At 812, method 800 judges if engine exhaust temperature is less than a threshold temperature. If so, the answer is yes and method 800 proceeds to 814. Otherwise, the answer is no and method 800 returns to 810.

At 814, method 800 performs the engine off natural vacuum (ENOV) evaporative emissions system diagnostic. In particular, method 800 closes the CVV and the canister purge valve while monitoring vacuum in the evaporative emissions system. Method 800 proceeds to 816.

At 816, method 800 judges if pressure in the evaporative emissions system is less than a threshold. If so, the answer is yes and method 800 proceeds to 840. Otherwise, the answer is no and method 800 proceeds to 818.

At 818, method 800 judges if the evaporative emissions diagnostic has been activated for a threshold amount of time. If so, the answer is yes and method 800 proceeds to 830. Otherwise, the answer is no and method 800 returns to 816.

At 840, method 800 indicates that the evaporative emissions diagnostic has passed. Method 800 may indicate that the evaporative emissions diagnostic has passed via displaying a message or setting a value of a variable in controller memory. Method 800 proceeds to exit.

At 820, method 800 determines a cumulative amount of air that passed through the engine during a most recent drive of the vehicle (e.g., where the vehicle is started, driven for a distance, and then parked with the engine off). The cumulative amount of air that passes through the engine may be determined via storing data output from an air flow sensor while the engine is operating. Method 800 proceeds to 822.

At 822, method 800 judges if the cumulative amount of air that passed through the engine is greater than a threshold amount. The threshold amount may be based on the amount of heat energy that is expected to be delivered to the vehicle and the evaporative emissions system via the environment (e.g., ambient air temperature and solar load). If the expected amount of heat to be delivered to the evaporative emissions system via the environment is a first amount (e.g., a large amount), then the threshold level may be a second amount (e.g., a small amount). If the expected amount of heat to be delivered to the evaporative emissions system via the environment is a third amount (e.g., a small amount), then the threshold level may be a fourth amount (e.g., a large amount). The fourth amount may be greater than the second amount, and the threshold amount of air may be a function of the amount of heat that is expected to be added to or removed from the vehicle and evaporative emissions system. If method 800 judges that the cumulative air mass consumed or inducted into the engine during the most recent vehicle drive is greater than the threshold, the answer is yes and method 800 proceeds to 824. Otherwise, the answer is no and method 800 proceeds to 840. The cumulative air amount consumed by the engine may be an indication of how much heat is transferred from the engine to the evaporative emissions system. The greater the cumulative air amount, the greater the amount of heat that may be transferred to the evaporative emissions system.

At 824, method 800 performs the engine off pressure phase of an evaporative emissions system diagnostic test. In particular, method 800 closes the CVV and the canister purge valve while monitoring positive pressure in the evaporative emissions system. Method 800 proceeds to 826.

At 826, method 800 judges if pressure in the evaporative emissions system is greater than a threshold. If so, the answer is yes and method 800 proceeds to 840. Otherwise, the answer is no and method 800 proceeds to 828.

At 828, method 800 judges if the evaporative emissions diagnostic has been activated for a threshold amount of time. If so, the answer is yes and method 800 proceeds to 830. Otherwise, the answer is no and method 800 returns to 826.

At 830, method 800 indicates a degraded evaporative emissions system (e.g., an evaporative emissions system with a breach). Method 800 may indicate that the evaporative emissions system is degraded via displaying a message on a display. Method 800 may also take mitigating actions in response to a degraded evaporative emission system. For example, method 800 may instruct an autonomous driver to perform less aggressive maneuvers so that less fuel vapor may be generated. Method 800 proceeds to exit.

In this way, it may be possible to reduce a possibility of false positive indications of evaporative emissions system degradation. Weather information data may be a basis for selecting whether an evaporative emissions system monitors itself for a vacuum or a positive pressure as a means of determining the presence or absence of a breach of the evaporative emissions system.

Note that the example control and estimation routines included herein can be used with various engine and/or vehicle system configurations. Further, the methods described herein may be a combination of actions taken by a controller in the physical world and instructions within the controller. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, 13, 14, 15, V6, V8, V10, and V12 engines operating in natural gas, gasoline, diesel, or alternative fuel configurations could use the present description to advantage.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for operating an evaporative emissions system, comprising:

increasing cooling of an engine via a controller in response to an indication that a natural cooling of an evaporative emissions system will increase from a time the engine is stopped.

2. The method of claim 1, where the natural cooling of the evaporative emissions system is expected to increase for a predetermined amount of time beginning from the time the engine is stopped.

3. The method of claim 1, where increasing cooling of the engine includes opening a thermostat to increase coolant flow to the engine.

4. The method of claim 1, where increasing cooling of the engine includes activating an electric booster during deceleration of a vehicle that includes the engine.

5. The method of claim 1, where increasing cooling of the engine includes activating an electric booster after the engine is stopped.

6. The method of claim 5, further comprising opening a throttle while the engine is stopped.

7. The method of claim 1, where the natural cooling includes a decrease in ambient air temperature.

8. The method of claim 1, where the indication is provided via a remote server that includes weather data.

9. A vehicle system, comprising:

an engine;

an evaporative emissions system coupled to the engine;

a controller including executable instructions stored in non-transitory memory that cause the controller to perform an evaporative emissions system diagnostic while the engine is off, the evaporative emissions system diagnostic including pressurizing the evaporative emissions system in response to an indication that the engine is stopped during a time range where energy input from a vehicle environment into the evaporative emissions system is expected to increase within a threshold amount of time since the engine is most recently turned off.

10. The vehicle system of claim 9, where the pressurizing increases a pressure in the evaporative emissions system, and where the pressurizing is facilitated via ambient air temperature increasing.

11. The vehicle system of claim 10, further comprising additional executable instructions to close a canister vent valve to pressurize the evaporative emissions system.

12. The vehicle system of claim 9, where the evaporative emissions diagnostic includes generating a vacuum in the evaporative emissions system in response to an indication that the engine is stopped during a time range where energy input from a vehicle environment into the evaporative emissions system is expected to decrease within a threshold amount of time since the engine is most recently turned off.

13. The vehicle system of claim 9, further comprising additional executable instructions to indicate degradation of the evaporative emissions system.

14. The vehicle system of claim 9, further comprising additional executable instructions to adjust vehicle operation in response to degradation of the evaporative emissions system.

15. The vehicle system of claim 9, where the time range begins when the engine is stopped.

16. A method for operating an evaporative emissions system, comprising:

receiving weather forecast data to a controller; and performing a vacuum based evaporative emissions system diagnostic via a controller in response to the weather forecast data indicating increased cooling of an evaporative emissions system;

performing a pressurization based evaporative emissions system diagnostic via the controller in response to the weather forecast data indicating increased heating of the evaporative emissions system.

17. The method of claim 16, where the pressurization based evaporative emissions system diagnostic increases a pressure within the evaporative emissions system.

18. The method of claim 17, where the pressure is increased via ambient air temperature increasing.

19. The method of claim 16, further comprising closing a canister purge valve while performing the vacuum based evaporative emissions system diagnostic.

20. The method of claim 16, further comprising closing a canister purge valve while performing the pressurization based evaporative emissions system diagnostic.

* * * * *